US007326234B2

(12) United States Patent
Lieberman et al.

(10) Patent No.: US 7,326,234 B2
(45) Date of Patent: Feb. 5, 2008

(54) VENTED BOTTLE

(75) Inventors: Joshua Lieberman, Pompton Lakes, NJ (US); John Rousso, Trumbull, CT (US); Joel Brown, Hoboken, NJ (US)

(73) Assignee: Playtex Products, Inc., Westport, CT (US)

( * ) Notice: Subject to any disclaimer, the term of this patent is extended or adjusted under 35 U.S.C. 154(b) by 409 days.

(21) Appl. No.: 10/663,445

(22) Filed: Sep. 16, 2003

(65) Prior Publication Data

US 2005/0035078 A1 Feb. 17, 2005

Related U.S. Application Data

(60) Continuation-in-part of application No. 10/272,475, filed on Oct. 16, 2002, now Pat. No. 7,122,045, which is a continuation-in-part of application No. 10/054,510, filed on Nov. 13, 2001, now Pat. No. 6,645,228, and a continuation-in-part of application No. 09/906,320, filed on Jul. 16, 2001, now Pat. No. 7,163,113, and a continuation-in-part of application No. 09/639,508, filed on Aug. 16, 2000, which is a division of application No. 09/209,070, filed on Dec. 10, 1998, now Pat. No. 6,138,710.

(51) Int. Cl.
*A61J 17/00* (2006.01)

(52) U.S. Cl. ..... 606/236; 215/11.5

(58) Field of Classification Search ..... 606/234, 606/235, 236; 215/11.1, 11.2, 11.3, 11.4, 215/11.5; D24/45, 46, 196, 197
See application file for complete search history.

(56) References Cited

U.S. PATENT DOCUMENTS

| | | | |
|---|---|---|---|
| 956,741 | A | 5/1910 | Smith |
| 1,099,082 | A | 6/1914 | Decker |
| 1,541,330 | A | 6/1925 | Decker |
| 1,649,580 | A | 11/1927 | Geisler |
| 1,759,568 | A | 5/1930 | Fervers |
| 1,858,356 | A | 5/1932 | Brown |
| 2,204,683 | A | 6/1940 | Lambert |
| D130,791 | S | 12/1941 | Porthouse et al. |
| 2,366,214 | A | 1/1945 | Ramaker |
| 2,388,915 | A | 11/1945 | Heilborn |
| 2,613,671 | A | 10/1952 | Bonin |
| 3,022,915 | A | 2/1962 | Mullin |
| 3,075,666 | A | 1/1963 | Hoffstein |

(Continued)

FOREIGN PATENT DOCUMENTS

| | | |
|---|---|---|
| EP | 555165 | 8/1993 |
| JP | 05084279 | 4/1993 |
| JP | 05115535 | 5/1993 |

*Primary Examiner*—Kevin T. Truong
(74) *Attorney, Agent, or Firm*—Ohlandt, Greeley, Ruggiero & Perle, L.L.P.

(57) ABSTRACT

A vented bottle is provided. The vent is remote from the nipple. The bottle has a nipple simulating the shape, surface geometry and function of a woman's breast is provided. The nipple has a stem and a base. The base can have an areola region and a bulbous region. The areola region is positioned between the stem and the bulbous region, and can simulate the areola of a woman's breast. The bulbous region can simulate the region of a woman's breast surrounding the areola. The areola region can have a texture or surface geometry that is different from the texture or surface geometry of the stem or bulbous region.

22 Claims, 7 Drawing Sheets

U.S. PATENT DOCUMENTS 3,273,703 A 9/1966 Stribley
3,530,979 A 9/1970 Merrill
3,902,618 A 9/1975 Guerster et al.
4,238,040 A 12/1980 Fitzpatrick ..... 215/11
D264,993 S 6/1982 Kestenberg
D271,797 S 12/1983 Chrones ..... D24/46
D276,700 S 12/1984 Brown
4,505,398 A 3/1985 Kesselring
D278,311 S 4/1985 Brown
4,613,050 A 9/1986 Atkin
D286,071 S 10/1986 Fuller ..... D24/46
4,623,069 A 11/1986 White
D288,240 S 2/1987 Fuller ..... D24/46
D288,241 S 2/1987 Fuller ..... D24/46
4,676,386 A 6/1987 Phlaphongphanich ..... 215/11
4,723,668 A * 2/1988 Cheng ..... 215/11.5
D294,735 S 3/1988 Morano et al. ..... D24/46
D300,462 S 3/1989 English et al. ..... D24/45
4,834,099 A 5/1989 Schrooten ..... 128/360
4,867,325 A 9/1989 Dransfield
D303,839 S 10/1989 Fitzpatrick et al. ..... D24/46
4,993,568 A 2/1991 Morifuji et al.
5,020,680 A 6/1991 Bale
5,024,341 A 6/1991 Dekerle ..... 215/11.1
5,078,733 A 1/1992 Eveleigh et al.
5,129,532 A 7/1992 Martin ..... 215/11.1
5,145,077 A 9/1992 Rohrig
D330,938 S 11/1992 Sakashita ..... D24/196
5,211,299 A 5/1993 Manfredonia
5,269,426 A 12/1993 Morano ..... 215/11.6
D349,769 S 8/1994 Green
5,419,445 A 5/1995 Kaesemeyer ..... 215/11.1
D360,468 S 7/1995 Fuller ..... D24/196
5,544,766 A 8/1996 Dunn
D373,423 S 9/1996 Mazade et al.
5,553,726 A 9/1996 Park ..... 215/11.4
5,579,935 A 12/1996 Atkin
5,617,972 A 4/1997 Morano et al. ..... 221/33
D381,752 S 7/1997 McCoy ..... D24/196
5,653,732 A 8/1997 Sheehy ..... 606/236
D384,748 S 10/1997 Dunn
5,690,679 A 11/1997 Prentiss
5,747,083 A 5/1998 Raymond et al. ..... 426/117
5,806,711 A 9/1998 Morano et al. ..... 221/33
D404,825 S 1/1999 Reed
D405,530 S 2/1999 Manganiello et al. ..... D24/196
5,878,899 A 3/1999 Manganiello et al. ..... 215/11.6
5,881,893 A 3/1999 Manganiello ..... 215/11.5
D411,886 S 7/1999 Manganiello ..... D24/197
5,921,426 A 7/1999 Randolph ..... 220/495.06
D412,582 S 8/1999 Morano ..... D24/197
D413,983 S 9/1999 Shaw
D414,268 S 9/1999 Shaw
D417,275 S 11/1999 Conforti ..... D24/130
6,003,698 A 12/1999 Morano ..... 215/11.1
6,032,810 A 3/2000 Meyers et al. ..... 215/11.1
6,053,342 A 4/2000 Chomik ..... 215/11.5
D428,154 S 7/2000 Shaw
6,112,749 A 9/2000 Hall et al.
D433,143 S 10/2000 Chomik et al. ..... D24/197
6,161,710 A 12/2000 Dieringer et al.
D439,983 S 4/2001 Dealing
D440,316 S 4/2001 Tollman
D440,318 S 4/2001 Meyers
D441,086 S 4/2001 Morano ..... D24/197
D441,087 S 4/2001 Johansen
6,209,736 B1 * 4/2001 Chen et al. ..... 215/11.5
D441,870 S 5/2001 Randolph ..... D24/196
D441,872 S 5/2001 Johansen
D444,239 S 6/2001 Kobayashi et al.
6,241,110 B1 6/2001 Hakim
D445,193 S 7/2001 Manganiello et al.
6,253,935 B1 7/2001 Fletcher ..... 215/11.1
D447,570 S 9/2001 Shaw
6,371,315 B1 4/2002 Chien
D457,967 S 5/2002 Shaw
D459,815 S 7/2002 Pastucha
D463,567 S 9/2002 Morano
6,446,822 B1 9/2002 Meyers
D464,434 S 10/2002 Morano
D470,593 S 2/2003 Iodice
D478,669 S 8/2003 Wear
2002/0063103 A1 5/2002 Kiernan

* cited by examiner

VENTED BOTTLE

RELATED APPLICATION

This application is a continuation-in-part of application Ser. No. 10/272,475, filed Oct. 16, 2002 now U.S. Pat. No. 7,122,045, which is a continuation-in-part of application Ser. No. 10/054,510, filed Nov. 13, 2001 now U.S. Pat. No. 6,645,228, which claims priority in application Ser. No. 29/152,115, filed Oct. 29, 2001, the disclosures of which are incorporated in their entirety herein by reference. This application is also a continuation-in-part of application Ser. No. 09/906,320, filed Jul. 16, 2001 now U.S. Pat. No. 7,163,113, which claims priority in U.S. Design application Ser. No. 29/121,308, filed Apr. 5, 2000 and issued as U.S. Design Pat. No. 445,193, the disclosures of which are incorporated in their entirety herein by reference. This application is also a continuation-in-part of copending application Ser. No. 09/639,508, filed Aug. 16, 2000, which is a divisional application of application Ser. No. 09/209,070 filed on Dec. 10, 1998 and issued as U.S. Pat. No. 6,138,710, the disclosures of which are incorporated in their entirety herein by reference.

BACKGROUND OF THE INVENTION

1. Field of the Invention

The present invention relates to baby bottles. More particularly, the present invention relates to vented baby bottles.

2. Description of the Prior Art

Baby bottles having flexible nipples are commonly used to feed infants and children milk, formula, juices and other fluids. During use, however, as the baby sucks on the nipple and withdraws the fluid, a partial vacuum is formed within the bottle. This vacuum can make feeding more difficult, by requiring the baby to suck with much greater force, which can discourage the baby and cause it to stop feeding sooner than desired. Moreover, the vacuum can cause the nipple to collapse.

To address this problem, baby bottles have been developed with nipples that provide for venting. In U.S. Pat. No. 4,993,568 to Morifuji et al., an air vent is disposed along the nipple flange. The vent allows for the intake of air into the bottle through a portion of the nipple to alleviate the pressure differential or vacuum in the bottle. However, this bottle suffers from the drawback of venting during feeding whereby the air mixes with the liquid that is in proximity to the nipple, is ingested by the infant, and causes greater risk of gas and spitting up.

Bottle nipples allow mothers to bottle-feed their babies as a temporary or permanent alternative to breast-feeding. Babies become accustomed to the shape and function of a woman's breast during breast-feeding. Due to the significant differences in the shape and function between a woman's breast and conventional baby bottle nipples, babies experience difficulty when switching between breast-feeding and bottle-feeding. This can cause a baby to fail to take formula from a baby bottle nipple. Likewise, babies can grow accustomed to the shape and function of a particular conventional baby bottle nipple, creating difficulty for the baby to return to breast-feeding. This can cause a baby to fail to take milk from a woman's breast because of a developed preference for the shape, texture and function of the baby bottle nipple.

In U.S. Pat. No. 5,653,732 to Sheehy, a nipple that claims to have a "natural form" is disclosed. The nipple has an annular rim, a lower segment, an intermediate segment, an upper segment and a tip. The annular rim is used as a securing structure and is adjacent to, and integrally formed with, the lower segment having a large curved outer surface. The lower segment is adjacent to, and integrally formed with, the intermediate segment that has a smaller curved outer surface and is smaller than the lower segment. The intermediate segment is adjacent to, and integrally formed with, the upper segment that has a smaller curved outer surface than the intermediate segment. The upper segment is adjacent to, and integrally formed with, the tip. The disclosed nipple suffers from the drawback of having three segments or areas that do not simulate the shape and function of a woman's breast. Moreover, such nipples suffer from the drawback of collapsing.

Accordingly, there is a need for a baby bottle and/or a nipple that reduces or eliminates these drawbacks. There is a further need for a baby bottle that provides proper venting to alleviate the vacuum in the bottle while reducing or eliminating nipple collapse.

SUMMARY OF THE INVENTION

It is an object of the present invention to provide a bottle that reduces or eliminates gas and spitting up during feeding of an infant.

It is another object of the present invention to provide such bottle that reduces or eliminates nipple collapse.

It is yet another object of the present invention to provide such a bottle with a nipple having a shape, texture and function simulating a woman's breast.

It is yet a further object of the present invention to provide such a bottle with a nipple that promotes latching on to the areola region of the nipple.

It is still a further object of the present invention to provide such a bottle that facilitates manipulation and handling of the bottle.

These and other objects and advantages of the present invention are provided by a nipple having a stem and a base. The base is connected to the stem. The base has a minimum wall thickness of greater than about 0.05 inches.

In another aspect, an infant feeding assembly is provided. The assembly has a bottle and a nipple. The bottle has a vent. The nipple has a stem and a base connected to that stem. The nipple is removably connected to the bottle. The vent is disposed remote from the nipple. The base of the nipple has a minimum wall thickness of greater than about 0.05 inches.

In another aspect, an infant feeding assembly is provided that has a bottle, a nipple and a hood. The bottle has a first end and a second end. The first end is open. The nipple is removably connected to the first end of the bottle. The hood is selectively engageable with both the first end and the second end.

The nipple can be non-vented. The minimum wall thickness can alternatively be greater than about 0.075 inches. The bottle can have open first and second ends, with the nipple being connected to the first end and the vent being connected to the second end. The vent can be a removable vent disc.

The stem has a proximal end connected to the base. The proximal end has a first wall thickness. The first wall thickness can be equal to the minimum wall thickness. The stem has a distal end with a second wall thickness. The second wall thickness can also be less than the first wall thickness. The proximal end of the stem may have opposing sides with inwardly concave shapes when viewed in a front view. The opposing sides can be smoothly concave when viewed in the front view.

The base of the nipple can have an areola region and a bulbous region. The areola region can be disposed between the stem and the bulbous region. The bulbous region may have an outwardly convex shape. The areola region can also have an outwardly convex shape. The stem can have a first surface geometry, the areola region can have a second surface geometry, and the bulbous region can have a third surface geometry. At least a portion of the second surface geometry can be different from at least a portion of the first surface geometry or the third surface geometry.

The opening of the first end of the bottle can be substantially disposed in a first plane. The opening of the second end of the bottle can be substantially disposed in a second plane. The first and second planes can also intersect. The bottle can have a nipple ring that is removably connected to the first end for connecting the nipple to the bottle. The bottle can also have a bottom cap that is connected to the second end. The hood has an inner surface that may have a retaining member that selectively engages the hood with both the nipple ring and the bottom cap. The retaining member can also be a plurality of projections extending inwardly from the inner surface. Pairs of the plurality of projections can be diametrically opposed along the inner surface.

The assembly can also have a first vent and a second vent. The second end of the bottle is vented by the first vent. The hood is vented by the second vent. The first and second vents provide fluid communication between the bottle and the atmosphere when the hood is engaged with the second end. The first vent can be a removable vent disc. The second vent can be at least one air hole disposed through the hood.

Other and further objects, advantages and features of the present invention will be understood by reference to the following:

DETAILED DESCRIPTION OF THE INVENTION

Figure 1:
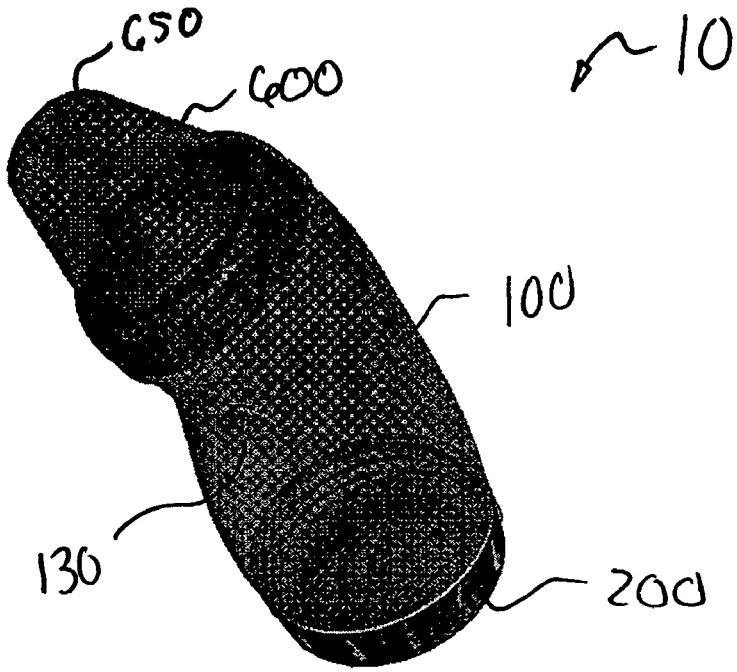
FIG. 1 is a perspective view of the bottle assembly of the present invention.

Referring to the figures and, in particular, FIGS. 1 through 4, the bottle assembly of the present invention is generally referred to by reference numeral 10. The bottle assembly 10 includes a bottle 100, a bottom cap 200, a vent 300, a nipple ring 400, a nipple 500, and a hood 600.

Bottle 100 has a first open end 105 and a second open end 110. Preferably, bottle 100 has an angled shape, i.e., the plane in which the opening of first open end 105 is substantially disposed intersects with the plane in which the opening of second open end 110 is substantially disposed. The angle between first open end 105 and second open end 110 facilitates manipulation and feeding for the infant, as well as improving venting within the bottle, as will be described later. Preferably, the angle of the bottle 100 is between about 10° to 90°, more preferably between about 20° to 45°, and most preferably about 25°.

Bottle 100 preferably has a lower portion 115 that narrows towards upper portion 120. More preferably, bottle 100 has a widened lower portion 115 thereby forming an indent or crease 125 along the side of the bottle forming the smaller angle. Indent 125 facilitates gripping of the bottle 100 and also provides the infant with a physical or geometric indicator for properly holding the bottle. Bottle 100 preferably has finger grips 130 (only one of which is shown) on opposing sides of the bottle. More preferably, finger grips 130 have a recessed or concave shape that facilitates handling and gripping for the user. Finger grips 130 have an oval shape and are preferably disposed closer to the upper portion 120 of the bottle 100.

In the preferred embodiment, the first open end 105 and the second open end 110 are threaded. More preferably, the threads are disposed upon necks of reduced diameter as compared to the diameter of the rest of bottle 100. However, the present invention contemplates the use of other securing methods and structures for assembly of the various components of bottle assembly 10. The bottle 100 is preferably transparent, to allow the contents and interior of the bottle 100 to be seen during feeding and cleaning.

Bottom cap 200 and vent 300 are adapted to secure to, and selectively seal, the second open end 110 of bottle 100. While in the preferred embodiment a selectively removable elastomeric vent disc 300 is used to provide selective venting for bottle 100, the present invention contemplates the use of other venting structures that are remote from nipple 500 and/or provide for venting without mixing of the air and fluid, such as, for example, co-molded elastomeric diaphragms or other valves, e.g., a duck-bill valve. Preferably, bottom cap 200 threadingly engages second open end 110 and holds vent disc 300 in a selectively sealing engagement with the second open end. The vent disc 300 is preferably mounted to the second end 110 by a compressive force exerted by the bottom cap 200.

The vent disc 300 preferably has a number of resealable perforations, apertures or slits 325 through a domed-shape center panel 330, to permit air to flow into the bottle 100 when a partial vacuum is formed in the bottle during feeding. The vent disc 300 also has a positioning member 350. Preferably, positioning member 350 extends from a center portion of vent disc 300 into a volume of bottom cap 200 so as to be accessible to a user for selectively engaging and disengaging the vent disc with the bottle assembly 10. While the preferred embodiment has a positioning member 350 for manipulation and handling of the vent disc 300, the present invention contemplates the use of other structures for manipulation and handling of the vent disc, such as, for example, finger grips or ridges.

The bottom cap 200 has a bottom recess 225 with a domed-shape base 250 and air vents 275 to provide fluid communication between the atmosphere and the vent disc 300. The domed-shape of upwardly convex base 250 preferably is similar to that of the vent disc 300. The bottom recess 225 preferably has a diameter that corresponds to the diameter of vent disc 300 to ensure that the vent disc is properly and securely seated in the bottom cap 200, so that a leak-proof seal will be formed when the bottom cap bearing the vent disc is attached to the bottle 100. More preferably, the diameter of the vent disc 300 (and the bottom recess 225) are large enough to cover second open end 110 but small enough so that the vent disc passes unobstructed through the inner threads on the bottom cap 200 to facilitate assembly.

The nipple ring 400 is mounted to the first end 105 of the bottle 100, and preferably is threadingly engaged therewith. The nipple 500, which will be discussed later in greater detail, preferably includes an annular mounting flange 585. In the preferred embodiment, the flange 585 of the nipple 500 seals against the first end 105 of the bottle 100 when the nipple ring 400 is screwed onto the bottle. Preferably, the nipple 500 is non-vented, i.e., it does not have a vent in its flange 585 or elsewhere, apart from its drinking aperture. Vent disc 300, and not a separate vent on the nipple 500, acts as the vent for the bottle 100 so as to prevent the mixing of air and fluid during feeding and venting.

Figure 2:
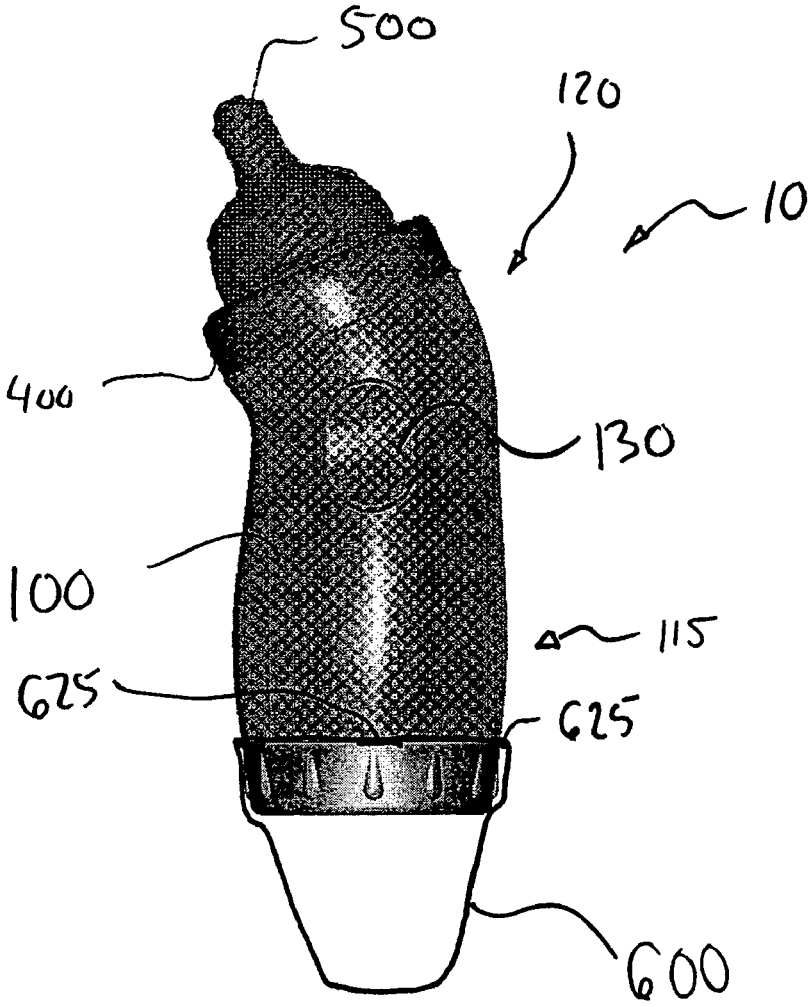
FIG. 2 is a plan view of the bottle assembly of FIG. 1 in a feeding configuration.
Figure 3:
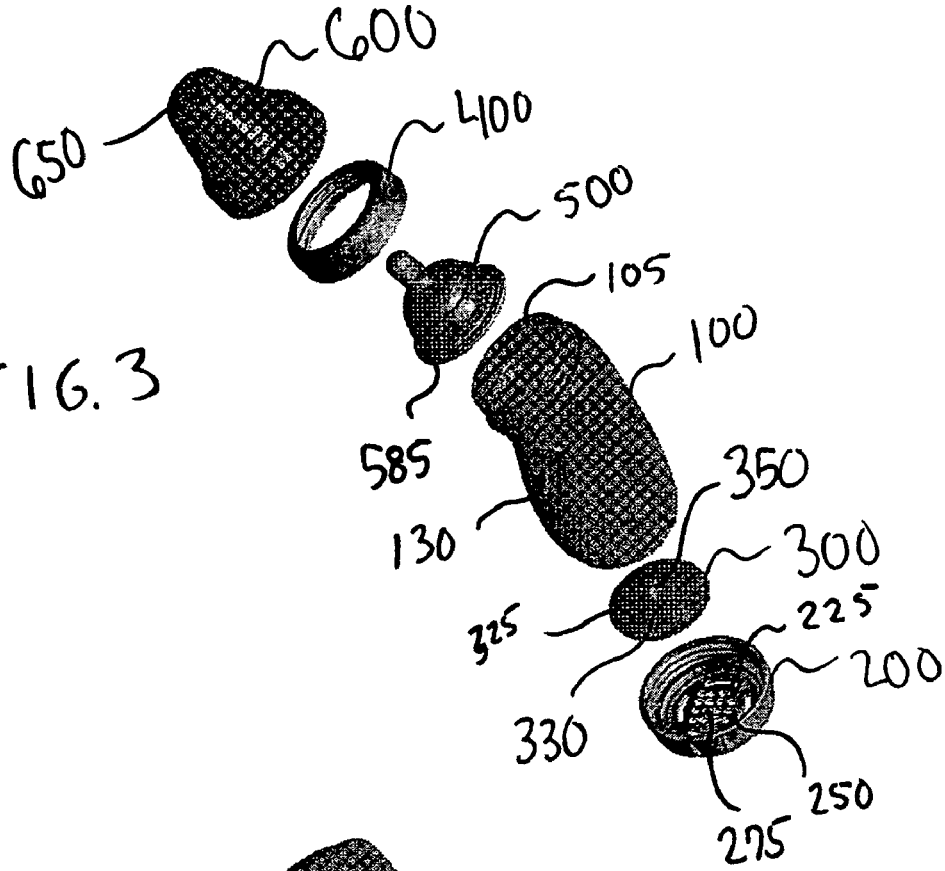
FIG. 3 is an exploded perspective view of the bottle assembly of FIG. 1.
Figure 4:
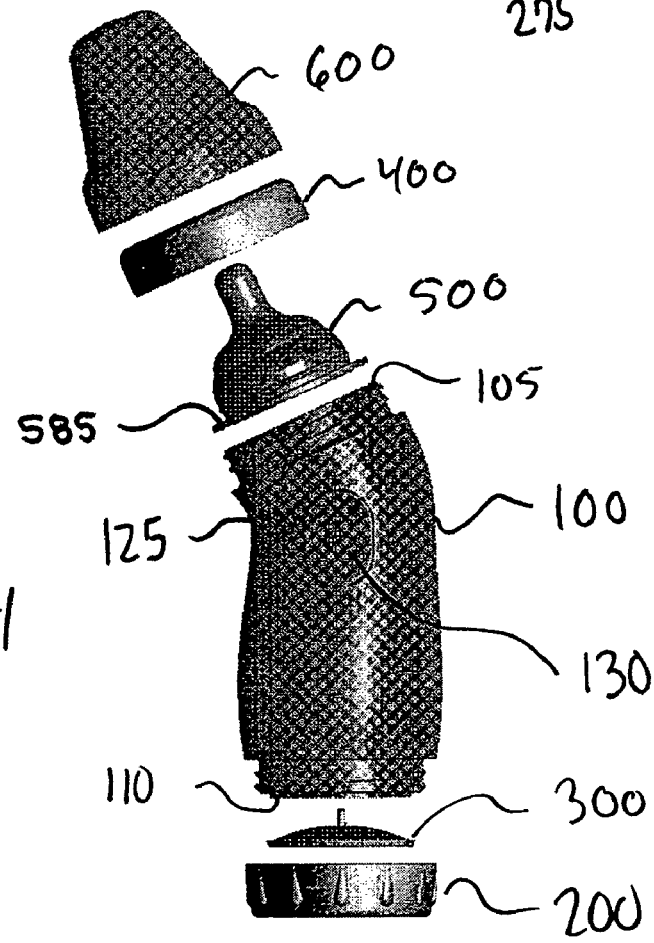
FIG. 4 is an exploded plan view of the bottle assembly of FIG. 1.

A protective hood 600 can be removably connected to the nipple ring 400 to keep the nipple 500 sanitary and to catch any leakage of fluid through the nipple. Preferably, hood 600 can also be connected to bottom cap 200, as shown in FIG. 2, such as during feeding so that a user may easily locate the hood after the feeding has ended. Hood 600 has retaining members 625 and air holes or vents 650. Retaining members 625 are projections or detents that extend inwardly from the inner surface of the hood and provide for engagement between the hood 600 and the nipple ring 400 or the bottom cap 200. Preferably, pairs of retaining members 625 are diametrically opposed along the inner surface of hood 600 to provide for a balanced engagement of the hood. Alternatively, other retaining structures or methods could also be used, such as, for example, a friction fit or threading engagement.

Air holes 650 through hood 600 provide for fluid communication between the atmosphere and the inner volume of the hood if a user engages the hood with the bottom cap 200 during feeding. This fluid communication allows vent disc 300 to vent the vacuum developing in the bottle 100 during feeding. Alternatively, other venting structures or methods could also be used for the hood 600, such as, for example, providing a separation between the engagement of the hood and the bottom cap 200.

Figure 5:
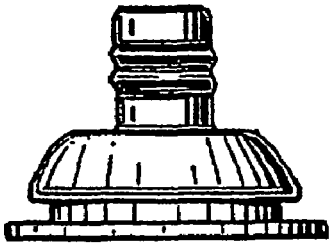
Fig. 5 (PRIOR ART)
FIG. 5 is a plan view of a prior art PLAYTEX® conventional nipple.
Figure 6:
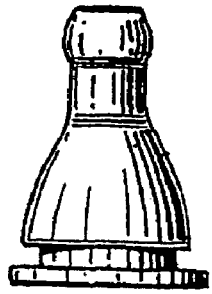
Fig. 6 (PRIOR ART)
FIG. 6 is a plan view of a prior art EVENFLO® conventional nipple.
Figure 7:
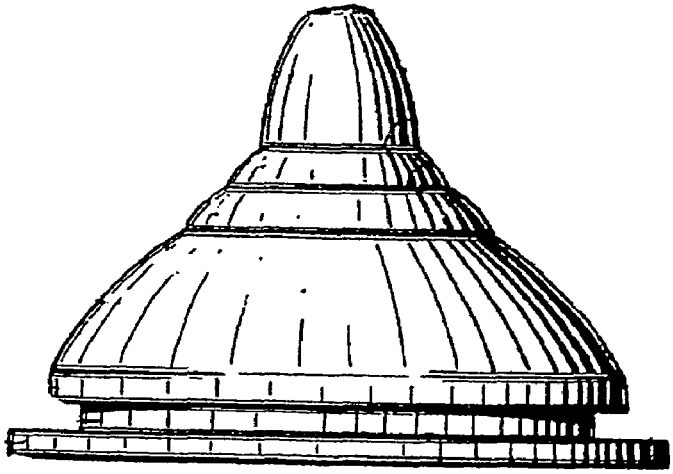
Fig. 7 (PRIOR ART)
FIG. 7 is a plan view of the nipple disclosed in U.S. Pat. No. 5,653,732.

Referring to FIGS. 5 through 7, there is shown prior art. FIG. 5 is a commercial PLAYTEX® nipple. FIG. 6 is a commercial EVENFLO® nipple. Both of these nipples do not simulate the shape, texture or function of a woman's breast. FIG. 7 is a nipple of U.S. Pat. No. 5,653,732. This nipple has three separate segments and a tip or teat. This prior art nipple fails to simulate the shape, texture or function of a woman's breast.

Figure 8:
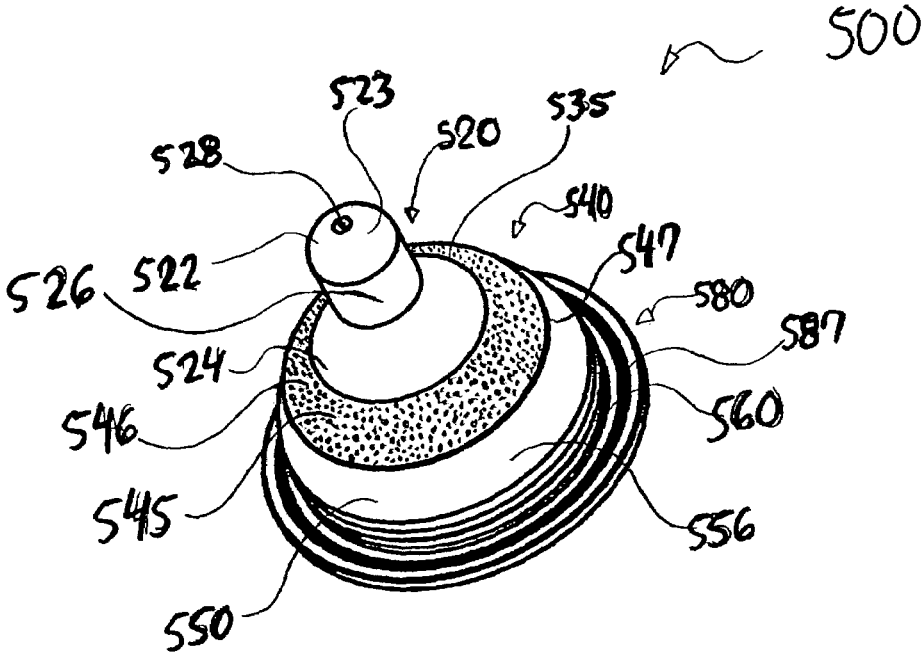
FIG. 8 is a perspective view of the nipple of the bottle assembly of FIG. 1.

Referring to FIGS. 8 trough 13, nipple 500 has a stem 520 and a base 540 connected to the stem. Nipple 500 preferably also has a securing structure 580. Stem 520 has a first or distal end 522, a second or proximal end 524, an outer surface 526 and a length L. Base 540 has an areola region 545 with an outer surface 546 and a bulbous region 550 with an outer surface 556.

Stem 520 is substantially cylindrical in shape and is inwardly tapered from second end 524 toward first end 522. Preferably, stem 520 is smoothly, inwardly tapered in the vicinity of second end 524. However, alternative tapering of stem 520 can also be used including tapering over the entire length L of the stem. First end 522 has an outwardly curved apex surface 523. Preferably, apex surface 523 of first end 522 has a radius of curvature of about 0.03 inches to about 0.30 inches. More preferably, apex surface 523 has a radius of curvature of about 0.15 inches to about 0.25 inches.

Second end 524 of stem 520 preferably has an inwardly concave or dish-like, circular shape and more preferably a smooth shape. Preferably, second end 524 has a radius of curvature of about 0.25 inches to about 0.50 inches. More preferably, second end 524 has a radius of curvature of about 0.30 inches to about 0.40 inches.

The tapered shape of stem 520 towards first end 522 helps promote proper "latch on" by the baby. During breast-feeding, the baby latches on to the areola of a woman's breast. Conventional nipples often promote latching on to the stem by having an indent located along the stem or being of a uniform cylindrical shape, as shown in the prior art of FIGS. 5 through 7. This improper latching on promotes "nipple confusion", i.e., a baby forgets how to properly latch-on to a mother's breast. The present invention provides tapered stem 520 that promotes latching on to areola region 545. The tapered shape of stem 520 causes the baby to slide past the stem and onto areola region 545.

Preferably, first end 522 of stem 520 at its widest point has a diameter of about 0.25 inches to about 0.75 inches, and second end 524 at its widest point has a diameter of about 0.40 inches to about 1.00 inches. More preferably, first end 522 at its widest point has a diameter of about 0.45 inches to about 0.55 inches, and second end 524 at its widest point has a diameter of about 0.55 inches to about 0.65 inches.

The present invention further provides an elongated stem 520. Stem 520 is elongated to simulate the extension of the stem or teat of a woman's breast during breast-feeding, which has a shorter length when not breast-feeding. Preferably, length L is about 0.50 inches to about 1.25 inches. More preferably, length L is about 0.75 inches to about 1.00 inches.

First end 522 of stem 520 has at least one hole 528 disposed therethrough. Preferably, hole 528 is located at or about the center point of apex surface 523 at first end 522. Hole 528 preferably is an inverted frusto-conical or inwardly tapered channel through stem 520. Hole 528 has a first open end 529 on an upper outer surface 530 of stem 520 and a second open end 531 on an upper inner surface 532 of the stem. First open end 529 preferably has a diameter of about 0.01 inches to about 0.05 inches. More preferably, first open end 529 has a diameter of about 0.02 inches to about 0.03 inches. Second open end 531 preferably has a diameter of about 0.005 inches to about 0.030 inches. More preferably, second open end 531 has a diameter of about 0.007 inches to about 0.015 inches.

To provide flexibility to stem 520 while maintaining resiliency to prevent nipple 500 from collapsing during feeding, s substantial portion of stem 520 preferably has a wall thickness of between about 0.02 inches to about 0.08 inches. More preferably, a substantial portion of stem 520 has a wall thickness of between about 0.04 inches to about 0.05 inches.

Second end 524 of stem 520 is secured to, and surrounded by, areola region 545 of base 540 along stem edge 535. Preferably, stem edge 535 is circular. Second end 524 is preferably integrally formed with areola region 545 along stem edge 535. Areola region 545 is designed to simulate the areola of a woman's breast. Areola region 545 preferably has an outwardly curved, convex or raised shape providing a raised appearance and feel. This raised appearance and feel allows a baby to latch on to areola region 545 just as a baby would latch on to the areola of a woman's breast during breast-feeding. Preferably, areola region 545 has a radius of curvature of about 0.25 inches to about 0.50 inches. More preferably, areola region 545 has a radius of curvature of about 0.30 inches to about 0.40 inches.

The preferred embodiment provides for different textures, surface geometries, and feels for different surfaces of nipple 500. The terms texture, surface geometry and feel include the shape of the surface when viewed parallel to the surface. The terms texture, surface geometry and feel also include different materials, or variations to the properties of a material, to provide a different feel for the baby, such as, for example, hard and soft materials or different coefficients of frictions between the materials.

Outer surface 546 of areola region 545 has a different texture, surface geometry or feel, on at least a portion thereof, as compared to at least a portion of outer surface 526 of stem 520 and at least a portion of outer surface 556 of bulbous region 550. Preferably, all of outer surface 546 has a different texture, surface geometry or feel than all of outer surface 526 and all of outer surface 556. By providing outer surface 546 with a different texture, surface geometry or feel as compared to outer surface 526 and outer surface 556, the baby receives a signal for latching on and also receives a grip for latching on. Preferably, outer surface 526 and outer surface 556 have a smooth texture, surface geometry or feel, while outer surface 546 of areola region 545 has a rough texture, surface geometry or feel. By providing outer surface 526 of stem 520 with a smooth texture, as well as tapering the stem, the baby will more easily slide down the stem and onto areola region 545 for proper latch on.

Outer surface 546 can have alternative textures or surface geometries including dimples, ribs or other non-smooth textures. While the present invention preferably has areola region 45 with an outwardly curved, convex or raised shape providing a raised appearance and feel, the present disclosure also contemplates other shapes and/or textures for areola region, such as, for example, concave or recessed, which facilitate an infant in latching on to the areola region. Also, areola region 545 with outer surface 546 can be a different material than stem 520 with outer surface 526 and bulbous region 550 with outer surface 556, such as, for example, the stem and bulbous region can be silicone and the areola region can be a plastic, such as, for example, a thermoplastic elastomer (TPE). Additionally, outer surface 546 can be a different material than the rest of nipple 500, such as, for example, molding nipple 500, including outer surfaces 526 and 556, with silicone or another material that is different from TPE, and over-molding TPE on outer surface 546. Outer surface 46 can have alternative textures or surface geometries including coarse, cross-hatched, egg-shelled, tactile, structured, such as dimples or ribs, or other non-smooth textures.

Preferably, the texture, surface geometry or feel of outer surface 546 and the texture, surface geometry or feel of outer surfaces 526 and 556, are obtained during the molding process. The desired texture is added to those portions of the cavity and core corresponding to outer surface 546 and outer surfaces 526 and 556. Alternatively, the texture, surface geometry or feel of outer surface 546 can be obtained by a secondary process after nipple 500 is molded. In this embodiment, the rough texture of outer surface 546 can be obtained by texturing that portion of the cavity and core corresponding to outer surface 546 by electrical discharge machining, chemical etching, or any other known machining or texturing method. The portion of the cavity and core corresponding to outer surface 526 of stem 520 and outer surface 556 of bulbous region 550 can be polished to a smooth or fine finish to provide for a smooth texture, surface geometry or feel of outer surfaces 526 and 556.

Areola region 545 is connected to, and surrounded by, bulbous region 550 along areola edge 547. Preferably, areola edge 547 is circular. More preferably, areola edge 547 has a diameter of about 1.20 inches to about 1.80 inches. Most preferably, areola edge 547 has a diameter of about 1.40 inches to about 1.50 inches. Areola region 545 is preferably integrally molded or formed with bulbous region 550 along areola edge 547.

Figure 9:
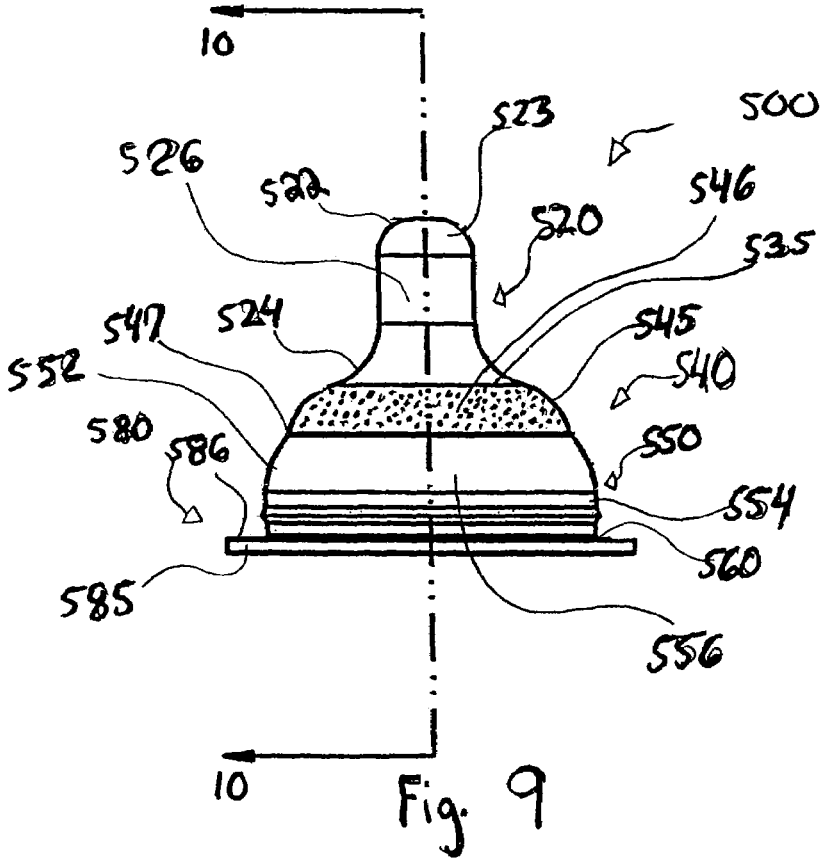
FIG. 9 is a plan view of the nipple of FIG. 8.
Figure 10:
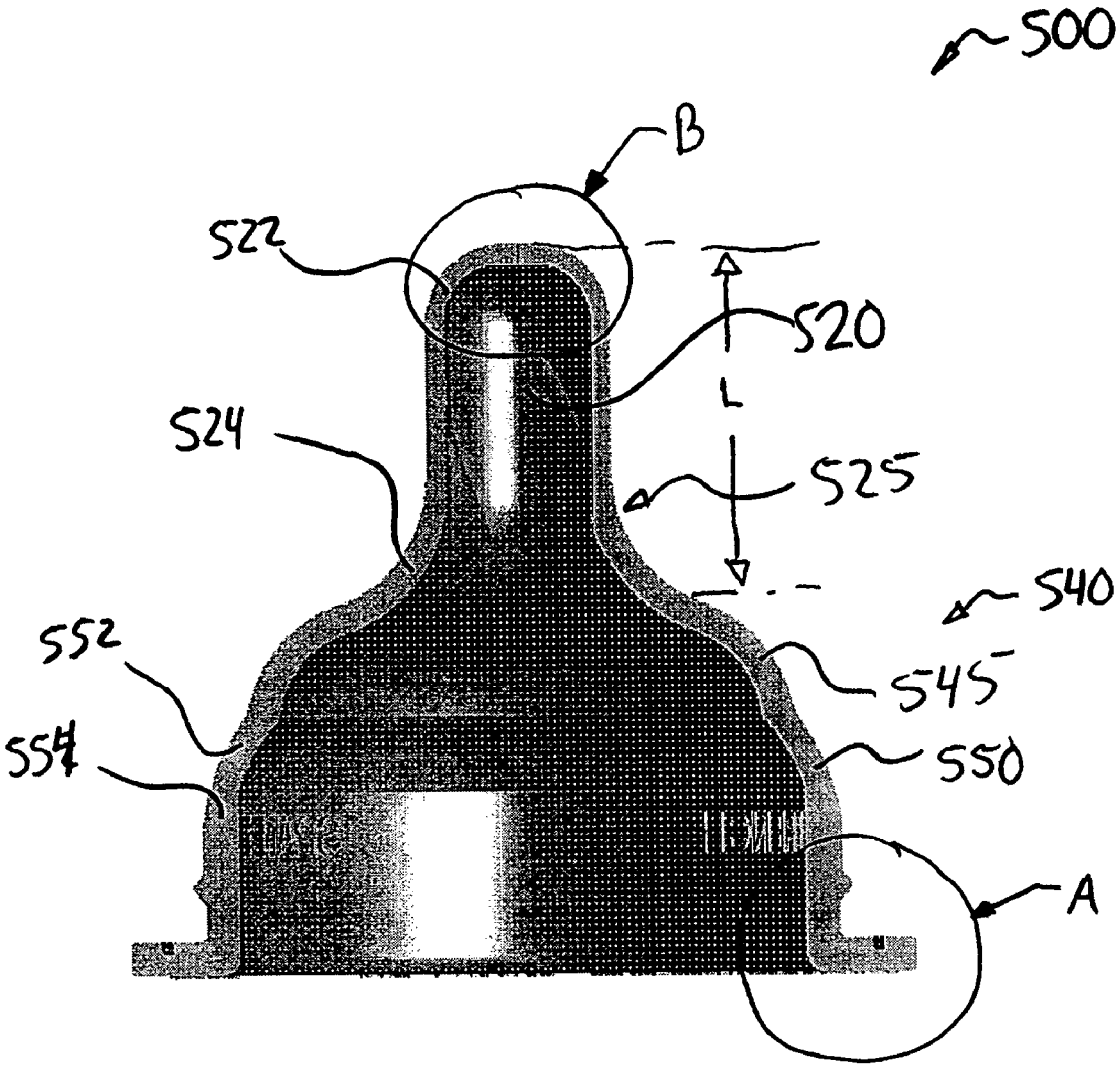
FIG. 10 is a cross sectional view of the nipple of FIG. 9 taken along line 10-10.
Figure 11:
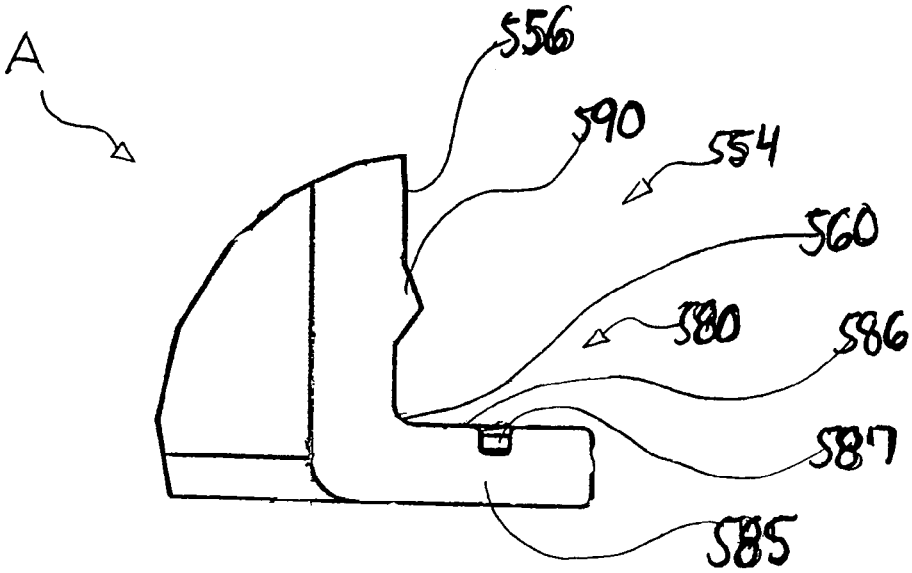
FIG. 11 is an enlarged view of portion A of FIG. 10.
Figure 12:
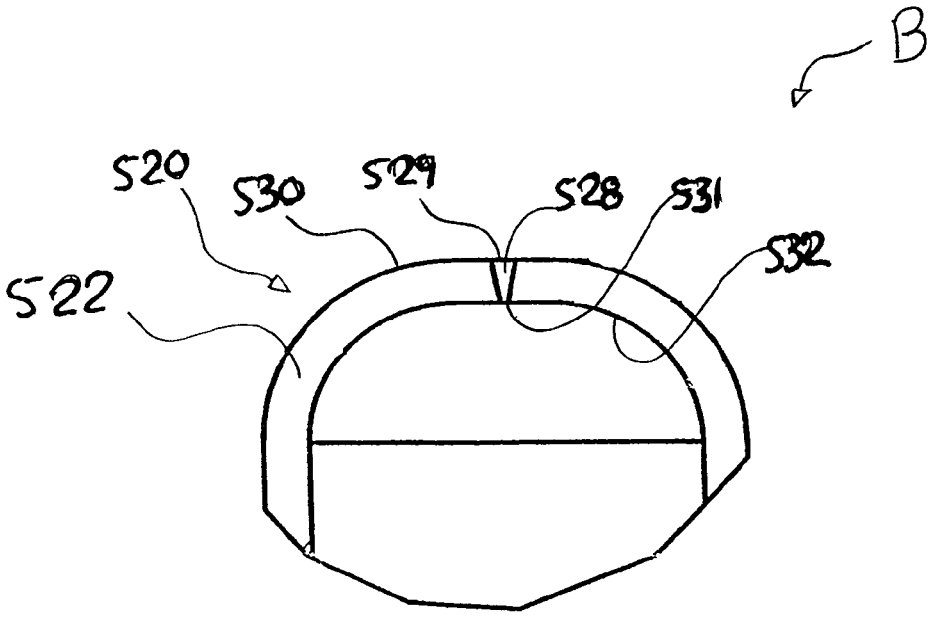
FIG. 12 is an enlarged view of Portion B of FIG. 10.
Figure 13:
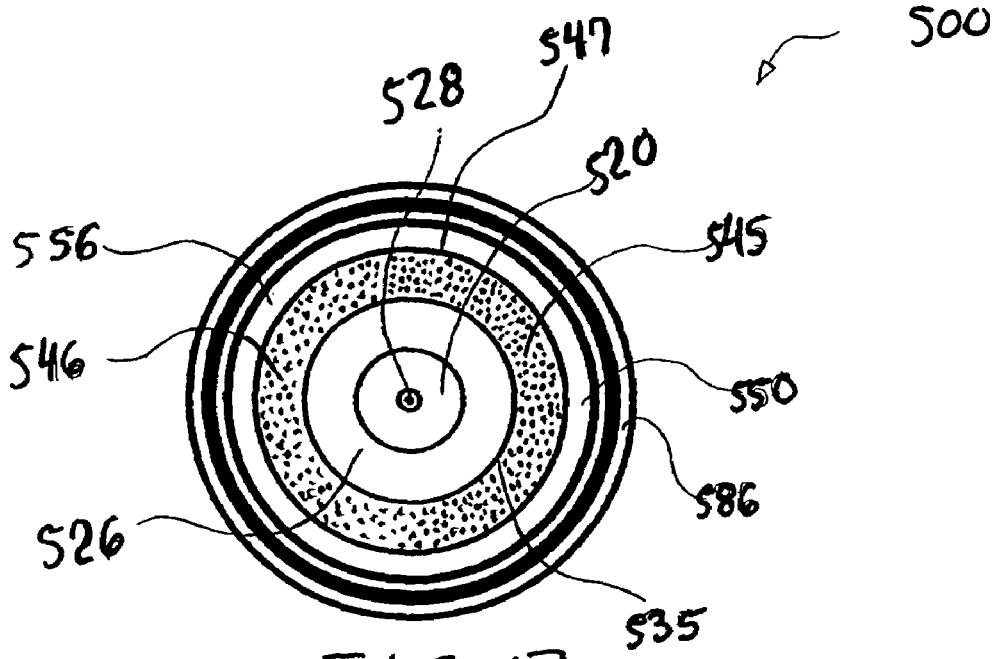
FIG. 13 is a top view of the nipple of FIG. 8.

Bulbous region 550 is designed to simulate the region of a woman's breast that surrounds the areola region. Bulbous region 550 preferably has an outwardly curved or convex shape. In the preferred embodiment, the surface area of bulbous region 550 is greater than the surface area of areola region 545. As shown in the top view of FIG. 13, areola region 545 is substantially concentrically aligned with bulbous region 550. Also, in the top view, stem 520 is substantially concentrically aligned with both areola region 545 and bulbous region 550. As shown in the front view of FIG. 9, second or proximal end 524 of stem 520 has opposing sides with inwardly concave shapes when viewed in the front view. Areola region 545 and second end 524 of stem 520 are connected along an inwardly smooth concave surface.

Bulbous region 550 comprises an upper portion 552 and a lower portion 554. Upper portion 552 extends curvingly downward from areola edge 547 to form an outwardly convex or raised shape. Preferably, upper portion 552 has a radius of curvature of about 0.25 inches to about 0.75 inches. More preferably, upper portion 552 has a radius of curvature of about 0.50 inches to about 0.60 inches. Lower portion 554 extends substantially vertically downward from upper portion 552. By providing outer surface 556 of bulbous region 550 with a smooth surface, as well as upper portion 552 of the bulbous region with an outwardly convex shape, the baby will more easily slide back onto areola region 545 for proper latch on.

Preferably, upper portion 552 has a wall thickness that is thinner than the wall thickness of lower portion 554. Lower portion 554 preferably has a wall thickness of about 0.03 inches to about 0.25 inches. More preferably, lower portion 554 has a wall thickness of about 0.08 inches to about 0.11 inches.

Bulbous region 550 is connected to, and surrounded by, securing structure 580 along bulbous edge 560. Bulbous edge 560 is preferably circular. Preferably, bulbous edge 560 has a diameter of about 1.50 inches to about 2.00 inches. More preferably, bulbous edge 560 has a diameter of about 1.70 inches to about 1.80 inches. Bulbous region 550 is preferably integrally formed with securing structure 580 along bulbous edge 560.

Securing structure 580 has flange 585 with an upper surface 586. Flange 585 extends outwardly from bulbous edge 560 and is preferably circular in shape. More preferably, flange 585 is perpendicular to outer surface 556 of lower portion 554. Preferably, flange 585 is integrally formed with and surrounds bulbous edge 560. Flange 585 preferably extends from bulbous edge 560 about 0.15 inches to about 0.50 inches. More preferably, flange 585 extends from bulbous edge 560 about 0.20 inches to about 0.25 inches. Flange 585 allows a nipple ring or other securing device to sealingly engage nipple 500 to baby bottle 100 through a downward compression force upon upper surface 586 of the flange against a rim or leading edge of the baby bottle.

Flange 585 preferably has a securing channel 587 formed in upper surface 586. Securing channel 587 is an annular channel or groove on upper surface 586 of flange 585. Securing channel 587 can be used for locking and sealing flange 585 to nipple ring 400. Preferably, securing channel 587 has a width of about 0.02 inches to about 0.05 inches, and a height of about 0.02 inches to about 0.05 inches.

Lower portion 554 of bulbous region 550 has a locking ring 590. Locking ring 590 is an annular ring extending outwardly from lower portion 554. Preferably, locking ring 590 is integrally formed or molded with lower portion 554. Locking ring 590 is preferably parallel to flange 585 so that the distance between the locking ring and the flange is the same along the entire circumference of lower portion 554. In this embodiment, locking ring 590 is triangular in shape but alternative shapes can be used, such as, for example, a semi-circular ring. Locking ring 590 provides an engagement structure or locking structure between nipple 500 and the nipple ring 400 so that the nipple and nipple ring can remain assembled while removed from the baby bottle.

Nipple 500 is preferably made of a flexible, resilient material. More preferably, nipple 500 is made from silicone, latex, or other rubber materials. This material provides flexibility to nipple 500 that further simulates the function of a woman's breast during breast-feeding.

During breast-feeding, a baby latches on to the areola region of a woman's breast. The present invention provides areola region 545 on nipple 500 for a baby to latch on to during bottle feeding. Areola region 545 is a raised or outwardly convex surface that facilitates latch on by the baby and promotes a more secure engagement for the baby, which reduces air leakage into nipple 500 or liquid leakage from the nipple. Conventional nipples, including the nipple disclosed in U.S. Pat. No. 5,653,732, fail to provide a single, distinct area that simulates the areola of a woman's breast. In providing areola region 545, the present invention provides nipple 500 that simulates a woman's breast during breast-feeding and reduces the difficulties associated with switching between breast-feeding and bottle-feeding.

Additionally, during breast-feeding, the areola of a woman's breast is pulled by the sucking force, resulting in inward and outward movement in the baby's mouth. The present invention further provides areola region 545 and upper portion 552 having thinner walls than lower portion 554. This provides a flexible region that causes areola region 545 of nipple 500 to have flexibility similar to that of a woman's breast when a sucking force is applied.

During testing of bottle assembly 10, unexpected and significant results occurred from the use of non-vented nipple 500, as compared to other non-vented nipples in vented bottles. The testing was done at approximate flow rates of 15 ml/min. and 30 ml/min. The nipples had minimum wall thicknesses along the base portion of the nipple, i.e., the smallest wall thickness over the entire area, including base portion 540 of nipple 500, ranging from 0.047 in. to 0.100 in. It was discovered based on the test data that the parameter of wall thickness and, in particular, a minimum wall thickness along the base portion 540 of greater than about 0.05 in. was a significant cause in preventing nipple collapse in vented bottles. These results are of statistical and practical significance.

Based on the test data, it was determined that a minimum wall thickness along the base portion 540 should preferably be greater than about 0.05 in., and more preferably be greater than or equal to about 0.075 in. It was further determined from this test data that the minimum wall thickness should preferably extend into the stem 520 to cover a transition portion 525. More preferably, transition portion 525 should include the inwardly concave portion of proximal end 524. Most preferably, transition portion 525 should extend up to the substantially straightened cylindrical wall portion of stem 520.

Figure 14:
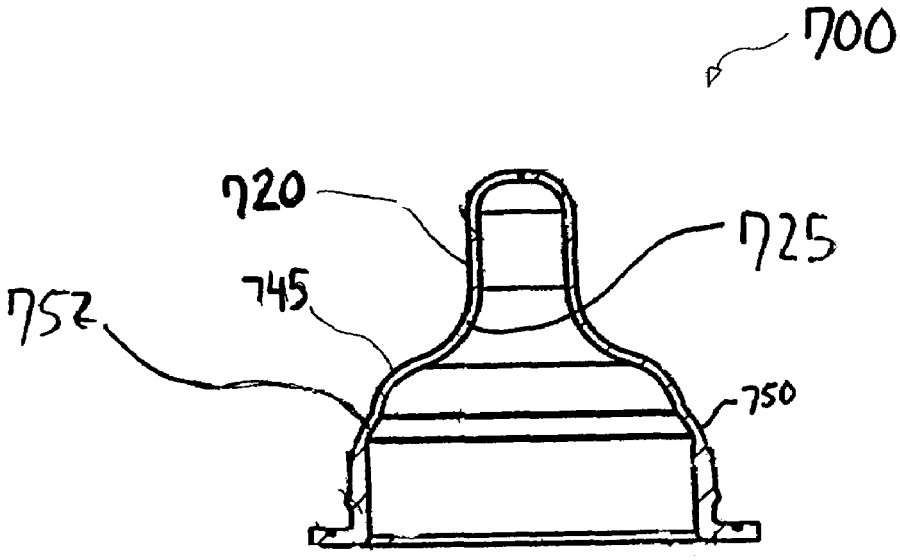
FIG. 14 is a cross-sectional view of an alternative embodiment of a nipple for use with the bottle assembly of FIG. 1.

Referring to FIG. 14, an alternative embodiment of a nipple is shown and generally represent by reference numeral 700. The areola region 745 preferably has the same or similar wall thickness as stem 720 even above transition portion 725. More preferably, stem 720 has the same or similar wall thickness as bulbous region 750 along upper portion 752.

The present invention having been thus described with particular reference to the preferred forms thereof, it will be obvious that various changes and modifications may be made therein without departing from the spirit and scope of the present invention as defined in the appended claims.

What is claimed is:

1. An infant feeding assembly comprising:

a bottle having a vent; and a nipple having a stem and a base connected to said stem, said nipple being connected to said bottle, said nipple being non-vented, wherein said vent is disposed remote from said nipple, and wherein said base of said nipple has a minimum wall thickness of greater than about 0.05 inches.

2. The assembly of claim 1, wherein said minimum wall thickness is greater than about 0.075 inches.

3. The assembly of claim 1, wherein said bottle has a first end and a second end, said first and second ends being open, wherein said nipple is connected to said first end, and wherein said vent is connected to said second end.

4. The assembly of claim 3, wherein said vent is a removable vent disc.

5. The assembly of claim 1, wherein said stem has a proximal end connected to said base, said proximal end having a first wall thickness, and wherein said first wall thickness is equal to said minimum wall thickness.

6. The assembly of claim 5, wherein said stem has a distal end with a second wall thickness, and wherein said second wall thickness is less than said first wall thickness.

7. The assembly of claim 1, wherein said stem has a proximal end connected to said base, said proximal end having opposing sides with inwardly concave shapes when viewed in a front view.

8. The assembly of claim 7, wherein said opposing sides are smoothly concave when viewed in said front view.

9. The assembly of claim 1, wherein said base has an areola region and a bulbous region, said areola region being disposed between said stem and said bulbous region, and wherein said bulbous region has an outwardly convex shape.

10. The assembly of claim 9, wherein said areola region has an outwardly convex shape.

11. The assembly of claim 9, wherein said stem has a first surface geometry, wherein said areola region has a second surface geometry, wherein said bulbous region has a third surface geometry, and wherein at least a portion of said second surface geometry is different from at least a portion of said first surface geometry or said third surface geometry.

12. The assembly of claim 1, wherein said bottle has a first end with a first opening, said first opening being substantially disposed in a first plane, wherein said bottle has a second end with a second opening, said second opening being substantially disposed in a second plane, and wherein said first and second planes intersect.

13. An infant feeding assembly comprising:

a bottle having a first end and a second end, said first end being open and said second end having a vent;

a nipple connected to said first end and being non-vented; and a hood, wherein said hood is selectively engageable with both of said first end and said second end.

14. The assembly of claim 13, wherein said second end is open, wherein said bottle has a nipple ring that is removably connected to said first end for connecting said nipple to said bottle, wherein said bottle has a bottom cap that is connected to said second end, wherein said hood has an inner surface having a retaining member, and wherein said retaining member selectively engages said hood with both of said nipple ring and said bottom cap.

15. The assembly of claim 14, wherein said retaining member is a plurality of projections extending inwardly from said inner surface, and wherein pairs of said plurality of projections are diametrically opposed along said inner surface.

16. The assembly of claim 13, further comprising a first vent and a second vent, wherein said second end of said bottle is vented by said first vent, and wherein said hood is vented by said second vent thereby providing fluid communication between said bottle and said atmosphere when said hood is engaged with said second end.

17. The assembly of claim 16, wherein said first vent is a removable vent disc.

18. The assembly of claim 16, wherein said second vent is at least one air hole disposed through said hood.

19. The assembly of claim 13, wherein said nipple has a stem and a base, wherein said base has an areola region and a bulbous region, said areola region being disposed between said stem and said bulbous region, and wherein said bulbous region has an outwardly convex shape.

20. The assembly of claim 19, wherein said areola region has an outwardly convex shape.

21. The assembly of claim 19, wherein said stem has a first surface geometry, wherein said areola region has a second surface geometry, wherein said bulbous region has a third surface geometry, and wherein at least a portion of said second surface geometry is different from at least a portion of said first surface geometry or said third surface geometry.

22. The assembly of claim 13, wherein said first end has a first opening substantially disposed in a first plane, wherein said second end has a second opening substantially disposed in a second plane, and wherein said first and second planes intersect.

* * * * *